US009617127B2

(12) United States Patent
Fuller et al.

(10) Patent No.: US 9,617,127 B2
(45) Date of Patent: Apr. 11, 2017

(54) DRUM ASSEMBLY AND METHOD OF ASSEMBLING THE DRUM ASSEMBLY

(75) Inventors: Jeffrey Fuller, Beverly Hills, MI (US); Falk Doering, Amiens (FR); Sebastien Ives, Pearland, TX (US); Guillaume Parmentier, Abbeville (FR); Judicael Albert, Grand-Laviers (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 318 days.

(21) Appl. No.: 13/881,868

(22) PCT Filed: Oct. 28, 2011

(86) PCT No.: PCT/US2011/058294

§ 371 (c)(1),
(2), (4) Date: Jul. 10, 2013

(87) PCT Pub. No.: WO2012/058543

PCT Pub. Date: May 3, 2012

(65) Prior Publication Data

US 2013/0284852 A1 Oct. 31, 2013

Related U.S. Application Data

(60) Provisional application No. 61/407,503, filed on Oct. 28, 2010.

(51) Int. Cl.
*B65H 75/14* (2006.01)
*B66D 1/30* (2006.01)

(52) U.S. Cl.
CPC ..... *B66D 1/30* (2013.01); *B65H 75/14* (2013.01); *B65H 2701/5134* (2013.01); *Y10T 29/49826* (2015.01)

(58) Field of Classification Search
CPC ..... B65H 75/14; B65H 2701/5134
(Continued)

(56) References Cited

U.S. PATENT DOCUMENTS 1,411,061 A 3/1922 Myers
3,099,417 A * 7/1963 Portal ..... 242/118.62
(Continued)

FOREIGN PATENT DOCUMENTS

FR 685641 A 7/1930
JP 6217240 A 1/1987
(Continued)

OTHER PUBLICATIONS

International Search Report for PCT Application Serial No. PCT/US2011/058294 dated Jun. 27, 2012.

*Primary Examiner* — Sang Kim
(74) *Attorney, Agent, or Firm* — Trevor G. Grove

(57) ABSTRACT

A drum assembly includes a core having a first end and a second end opposite the first end, a first hub coupled to the core adjacent the first end of the core, a second hub coupled to the core adjacent the second end of the core, a first flange releasably coupled to the first hub, the first flange including a body having an inner surface, an outer support structure, and an aperture formed therethrough, and a second flange releasably coupled to the second hub, the second flange including a body having an inner surface, an outer support structure, and an aperture formed therethrough.

5 Claims, 16 Drawing Sheets

(58) Field of Classification Search
USPC .... 242/608, 608.4–608.6, 609, 609.1–609.3, 242/610.6, 118.62, 614.1
See application file for complete search history.

(56) References Cited

U.S. PATENT DOCUMENTS

| | | | | |
|---|---|---|---|---|
| 3,332,664 | A | 7/1967 | Luketa | |
| 4,012,009 | A * | 3/1977 | O'Malley et al. | 242/118.62 |
| 4,756,488 | A | 7/1988 | Cooke | |
| 5,743,486 | A * | 4/1998 | Bulman | 242/608.5 |
| 5,806,788 | A | 9/1998 | Witwer et al. | |
| 7,644,907 | B2 | 1/2010 | Ives et al. | |
| 2002/0148925 | A1 * | 10/2002 | Cox et al. | 242/608.6 |
| 2005/0092281 | A1 | 5/2005 | Choi | |
| 2007/0241226 | A1 * | 10/2007 | Manzo | 242/608.3 |

FOREIGN PATENT DOCUMENTS

| | | | |
|---|---|---|---|
| JP | 6224868 | A | 2/1987 |
| JP | 11-147694 | A | 9/1998 |
| JP | 2001158571 | A | 6/2001 |
| JP | 2005140322 | A | 6/2005 |

* cited by examiner

DRUM ASSEMBLY AND METHOD OF ASSEMBLING THE DRUM ASSEMBLY

BACKGROUND

The statements in this section merely provide background information related to the present disclosure and may not constitute prior art.

The present invention relates generally to a winch drum and, in particular, to a multi-element drum assembly.

Wireline winch drums are typically used in oilfield operations. In certain applications, a logging tool is attached to a cable and the cable is spooled on a drum. A cable tension applied to the drum is determined by the cable length and type, the tool string weight, the well-bore geometry, and formation characteristics, for example. The cable tension generates two types of load on the drum: a pressure applied on a core of the drum; and a pressure applied on a flange of the drum.

The core of the drum is typically exposed to the resulting tension forces from cable loads applied through the flanges. A large bending moment is typically created at a junction (i.e. core/flange junction) of the core and each of the flanges. The various loads applied to the drum often generate stresses at the core/flange junction. Accordingly, stresses at the core/flange junction pose a risk for crack initiation due to the fatigue condition created during the cyclical loading and unloading during normal loggings.

High stresses in a conventional core-flange junction cannot be resolved using traditional methods, such as reinforcement.

It is always desirable to provide a drum and a method of assembling the drum, wherein the drum and the method minimize a stress and fatigue of the drum at a core/flange junction while maximizing load capacity of the drum.

SUMMARY OF THE DISCLOSURE

An embodiment of a drum assembly includes a core having a first end and a second end opposite the first end. A first hub is coupled to the core adjacent the first end of the core. A second hub is coupled to the core adjacent the second end of the core. A first flange is releasably coupled to the core and the first hub, and the first flange has a body having an inner surface, an outer support structure, and an aperture formed therethrough. A second flange is releasably coupled to the second hub and includes a body having an inner surface and an outer support structure.

An embodiment of a drum assembly includes a core having a length defined between a first end and a second end. A first hub is integrally formed with the second end of the core. A first flange is removably secured to the first hub. A second hub and a second flange are removably secured to the first end of the core.

The present invention also includes methods for assembling a drum.

One method involves providing a core having a length defined between a first end and a second end opposite the first end. The first end has a first hub monolithically formed adjacent thereto. The method further includes providing a second hub having at least two segmented portions that together define an aperture configured to receive at least a portion of the core therethrough. Furthermore, the method includes securing a first flange to the first hub adjacent to the first end. In addition, the method includes securing a second flange adjacent to the second end of the core and securing the second hub to the second flange and the core.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
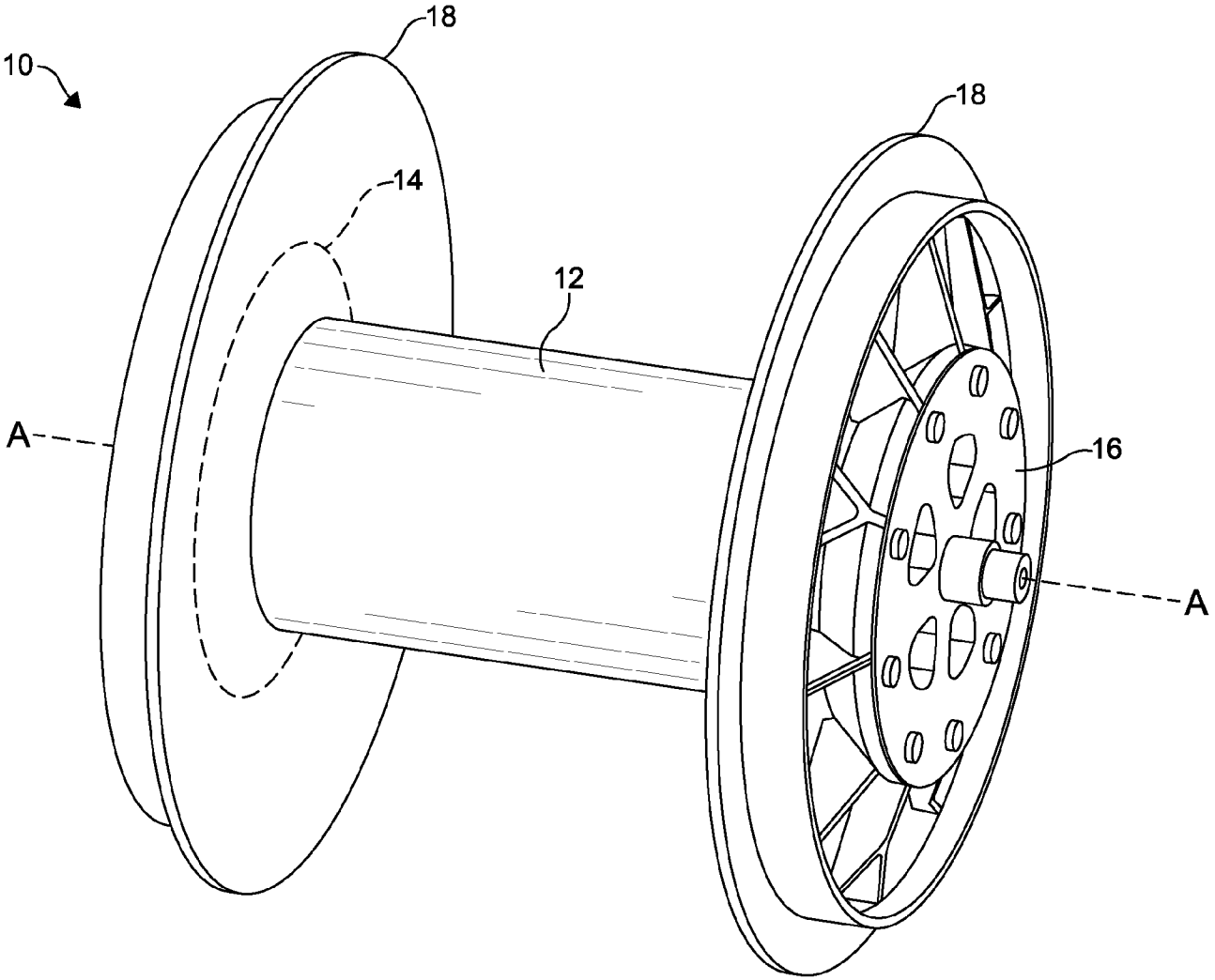
FIG. 1 is a perspective view of a drum assembly according to an embodiment of the present disclosure.
Figure 2:
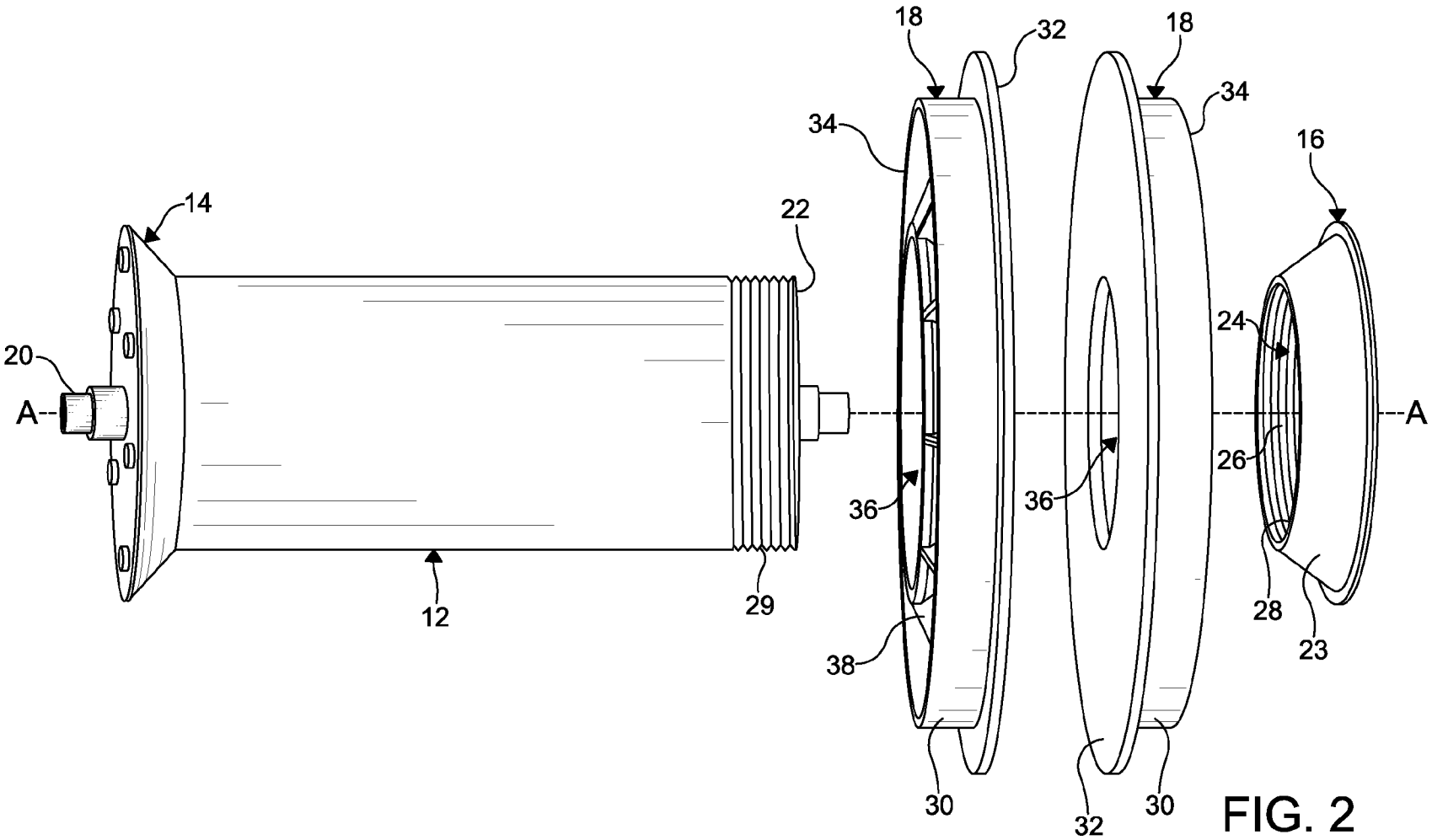
FIG. 2 is an exploded front perspective view of the drum assembly of FIG. 1.

Referring now to FIGS. 1-6, there is shown an embodiment of a drum (i.e. drum assembly), indicated generally at 10. The drum 10 may be used in the oilfield industry, such as in a wireline logging application. As a non-limiting example, the drum 10 is generally configured to store and convey a wireline cable (not shown) that may provide data and/or power to a logging tool deployed in a wellbore. However, other applications can make use of the drum 10, including any wire, cable, or other material wound on a drum. As a further non-limiting example, the drum 10 is formed of a metallic material, for example the drum 10 may be casted from manganese steel. However, other materials can be used to form the drum 10, as appreciated by a person having ordinary skill in the art.

As shown, the drum 10 includes a core 12, a pair of hubs 14, 16 (also referred to herein as a first huh 16 and a second hub 14) disposed adjacent a portion of the core 12, and one or more flanges 18 disposed adjacent each of the hubs 14, 16, It is understood that the drum 10 can include additional components such as a sprocket (not shown), for example. It is further understood that the drum 10 can store a certain length of cable, depending on a diameter of the core 12 and a length/diameter of the each of the flanges 18, The core 12 has a generally cylindrical and round cross-sectional shape extending along a longitudinal axis A-A and is typically configured to rotate about the longitudinal axis A-A. In certain embodiments, the core 12 is hollow. However, it is understood that the core 12 can have any size and shape. In certain embodiments, the second hub 14 is integrally formed or monolithically formed (e.g. cast) with the core 12 and disposed adjacent an end 20 of the core 12. In certain embodiments, the first hub 16 is releasably coupled to the core 12 adjacent another end 22 of the core 12 opposite the end 20. It is understood that each of the hubs 14, 16 can be releasably coupled to the core 12.

Figure 3:
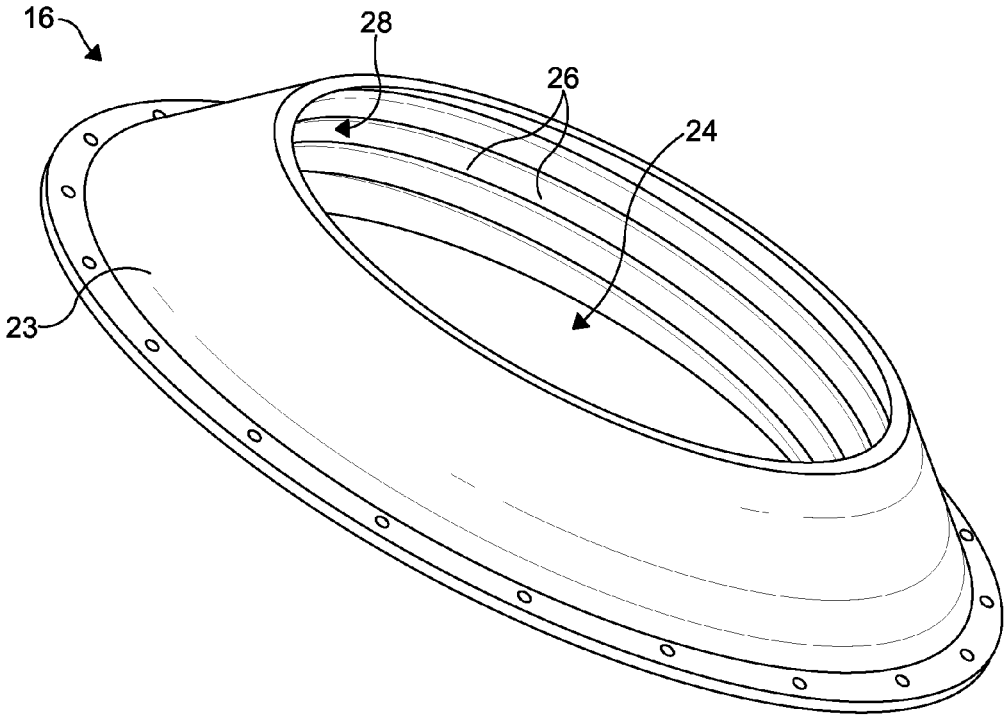
FIG. 3 is an enlarged perspective view of a separable hub of the drum assembly of FIG. 1.

As more clearly shown in FIG. 3, the hub 16 has a generally frusto-conical body 23 with an aperture 24 formed therein. As a non-limiting example, the hub 16 includes a first coupling mechanism 26, such as threads (e.g. helical threads) formed on an interior surface 28 defining the aperture 24 to threadably couple the hub 16 to a portion of the core 12. As a further non-limiting example, a portion of the core 12 (e.g. adjacent the second end 22 of the core 12) includes a second coupling mechanism 29, such as threads (e.g. a corresponding helical thread) to cooperate with the coupling means 26 to secure the hub 16 to the core 12. It is understood that the hub 16 can be locked into a static position relative to the core 12 using a mechanical key system (not shown) known in the art. It is further understood that the hub 14 can be formed as a separable component from the core 12 and configured substantially similarly to the hub 16.

Figure 4:
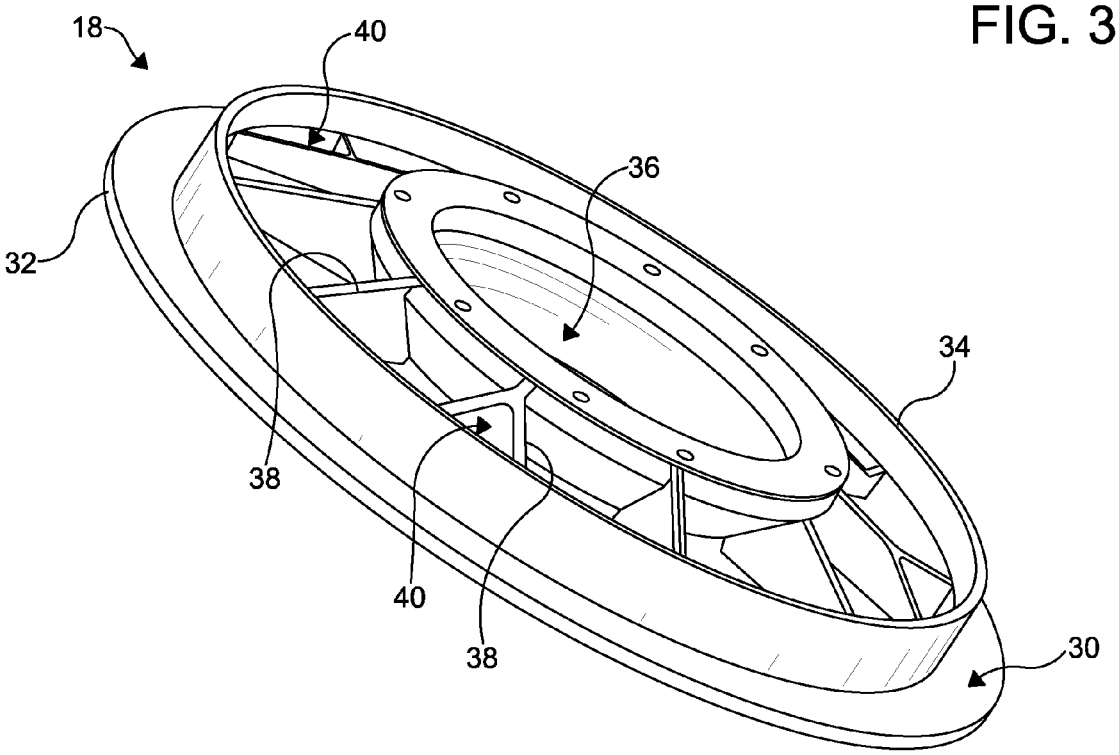
FIG. 4 is a perspective view of a flange of the drum assembly of FIG. 1.
Figure 5:
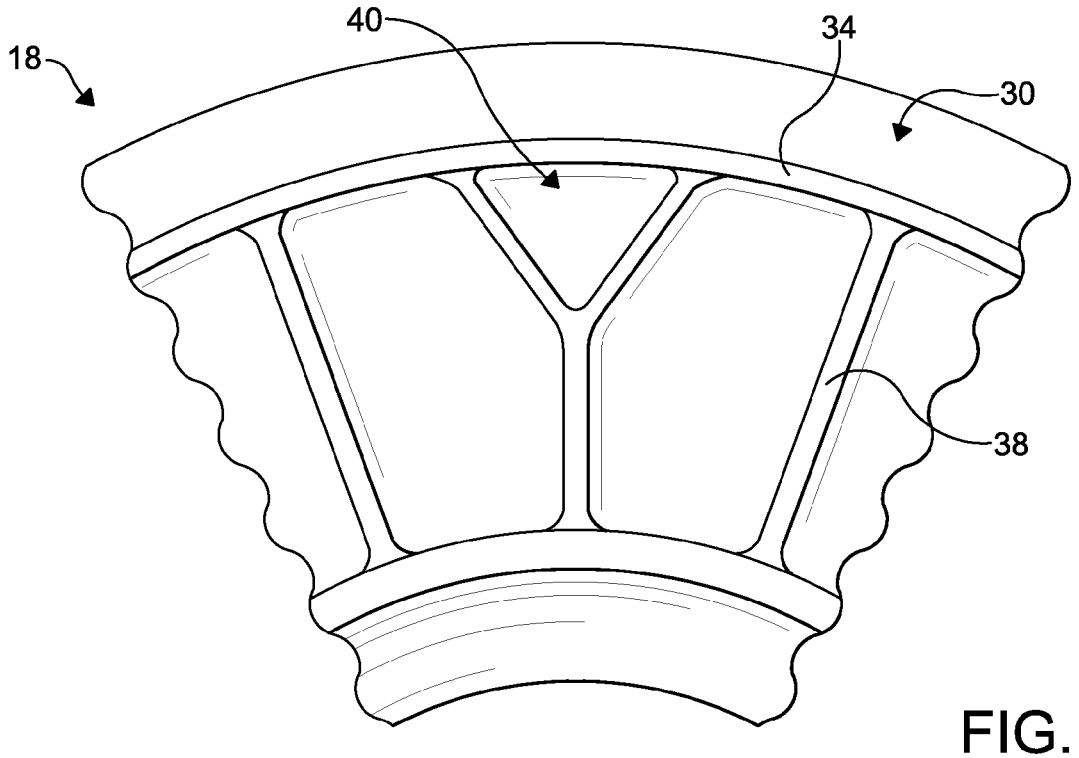
FIG. 5 is an enlarged fragmentary elevation view of the flange of FIG. 4.

As more clearly shown in FIGS. 4 and 5, each of the flanges 18 has a body 30 with an inner surface 32, an outer support structure 34, and an aperture 36 formed therein. The inner surface 32 of each of the flanges 18 is typically planar and is configured to face the inner surface 32 of another one of the flanges 18 when the drum 10 is assembled. The outer support structure 34 of the body 30 of each of the flanges 18 includes a plurality of support spokes 38 extending radially outwardly from the aperture 36. At least one of the support spokes 38 is generally "Y" shaped to provide a designated lifting region 40 (i.e. pocket) for lifting and transporting the assembled drum 10. It is understood that any number of the support spokes 38 can be configured to provide a desired number of the lifting regions 40. The aperture 36 formed in the body 30 of each of the flanges 18 is generally frusto-conical, wherein an inner diameter of the aperture 36 is smallest at an end of the flange 18 adjacent the inner surface 32 and wherein the inner diameter is largest at an end of the flange 18 adjacent the outer support structure 34. As a non-limiting example, the aperture 36 is configured and sized to receive one of the hubs 14, 16. As a further non-limiting example, each of the flanges 18 is releasably coupled to one of the hubs 14, 16. The outer support structure 34 may be utilized as a surface to engage with a brake or brake band (not shown) when the drum 10 is in use, for example, for conveying a cable into a wellbore to perform an operation in a wellbore.

Figure 6:
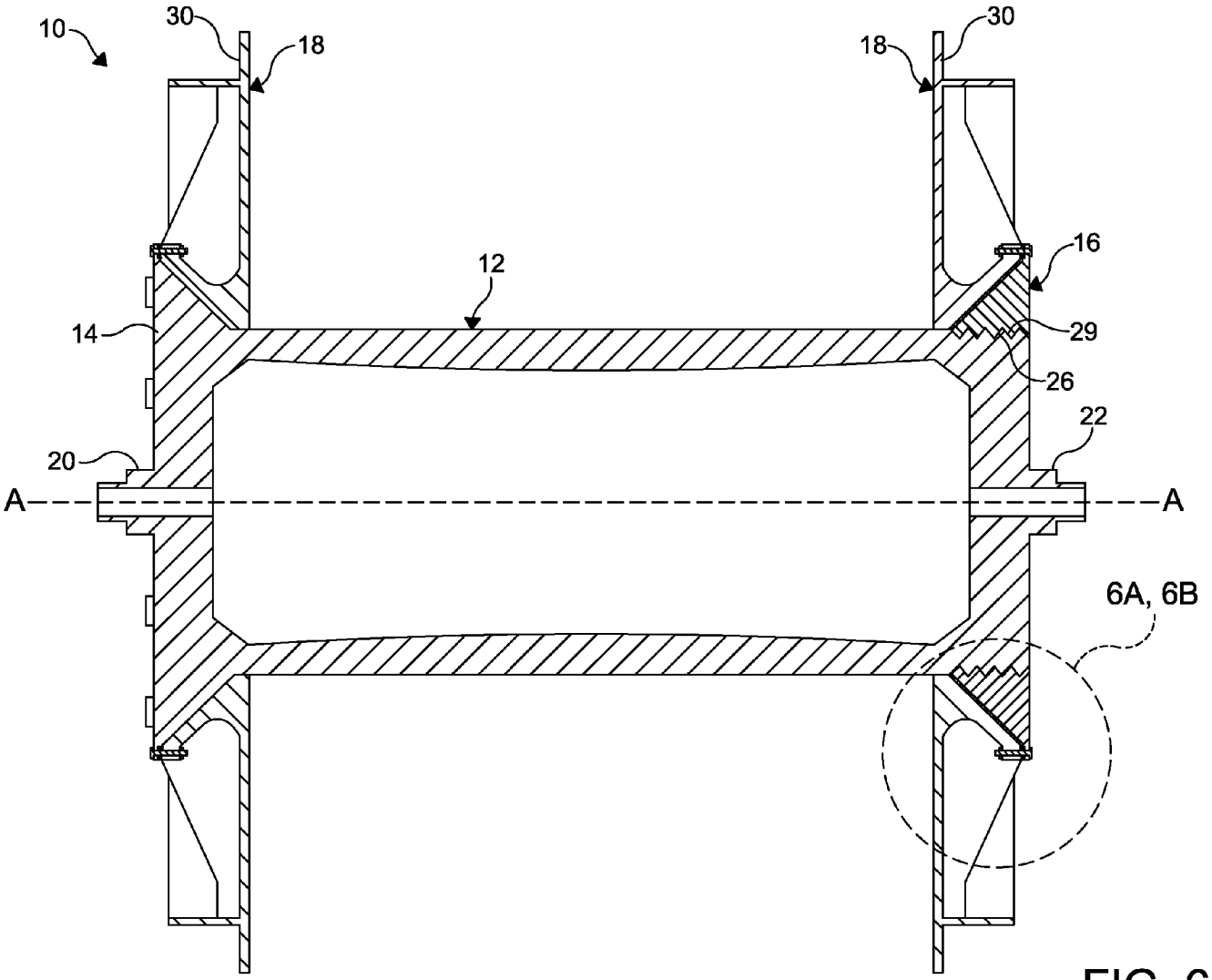
FIG. 6 is a cross-sectional front elevation view of the drum assembly of FIG. 1.
Figure 6A:
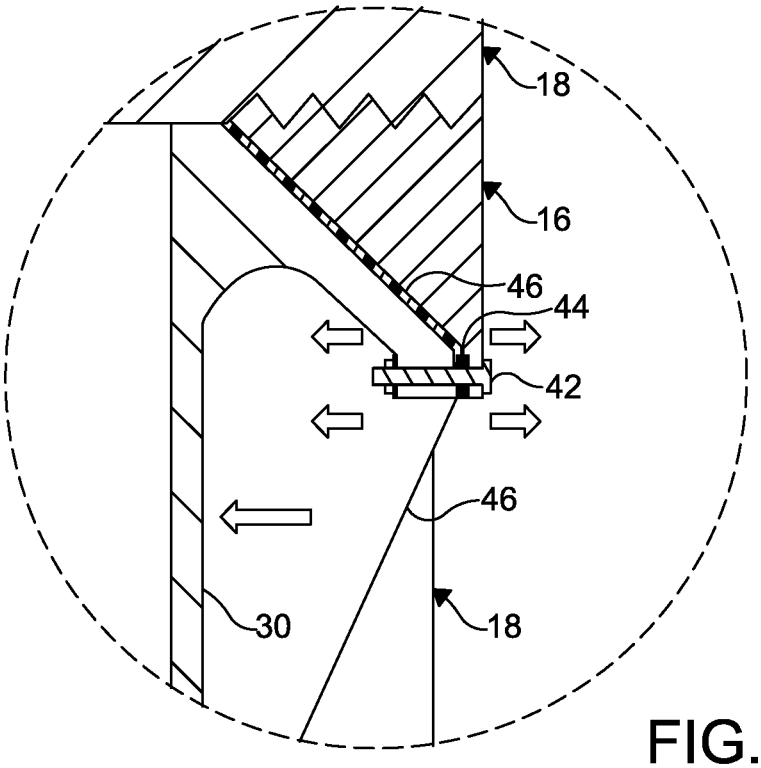
FIG. 6A is an enlarged view of a portion of the drum assembly of FIG. 1, showing force vectors for an empty drum.
Figure 6B:
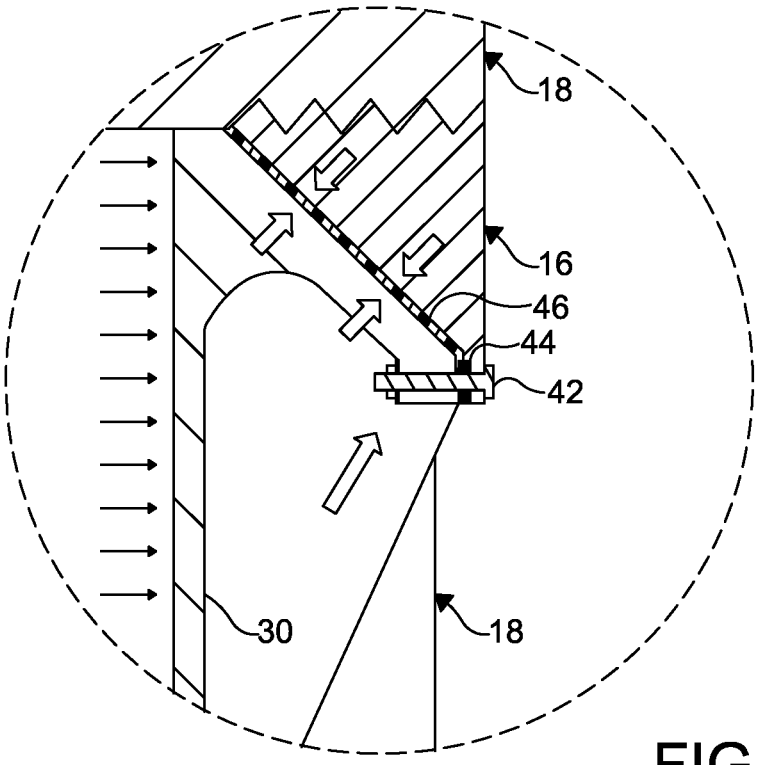
FIG. 6B is an enlarged view of a portion of the drum assembly of FIG. 1, showing force vectors for a loaded drum.

As more clearly shown in FIGS. 6, 6A and 6B, at least one fastener 42 is disposed through each of the hubs 14, 16 and extends through the body 30 of an adjacent one of the flanges 18. As a non-limiting example, the fastener 42 is a one-way fastener. However, other fasteners can be used. A spacer 44 (typically formed from rubber) having a pre-determined rigidity is disposed around an outer circumference of at least a portion of the fastener 42 and between the hub 14, 16 and the body 30 of an adjacent one of the flanges 18. In certain embodiments, a coating 46 (e.g. polymer) is applied to a portion of each of the hubs 14, 16 that abuts a portion of the body 30 of an adjacent one of the flanges 18 when the drum 10 is assembled. It is understood that the coating 46 can be applied to at least one of the hubs 14, 16 and the body 30 of each of the flanges 18 to facilitate a substantially even distribution of load therebetween, as well as to minimize a corrosion thereof. It is understood that the fastener 42 provides a proper placement of each of the flanges 18 in reference to a respective one of the hubs 14, 16 and secures the flanges 18 in the case of an empty drum 10, as illustrated in FIG. 6A. It is further understood that during a loading of the drum 10, the spacer 44 minimizes a transmission of lateral loads to the flanges 18, thus protecting the hubs 14, 16 from damage, ensuring a proper geometry of force transmission, and minimizing a required weight of each of the hubs 14, 16, as illustrated in FIG. 6B.

In use, the core 12 is positioned such that a pre-defined "sprocket end" (e.g. first end 20) of the core 12 is facing downward. A surface of the integral hub 14 is prepared with the coating 46, as described above. In certain embodiments, where the hub 14 is separable from the core 12, the hub 14 can be coupled to the core 12 in a fashion similar to the hub 16. Once the hub 14 is in a proper position, a first one of the flanges 18 is guided over the core 12 such that a portion of the core 12 passes through the aperture 36 formed in the body 30 of the first one of the flanges 18. The first one of the flanges 18 is coupled to the integral hub 14 using a pre-determined number of the fastener(s) 42. In certain embodiments, a pre-determined number of the spacers 44 are disposed between the hub 14 and an adjacent one of the flanges 18. A second one of the flanges 18 is guided over the core 12 such that a portion of the core 12 passes through the aperture 36 formed therethrough. In certain embodiments, the second one of the flanges 18 is lowered over the core 12 to rest on the first one of the flanges 18. The separable hub 16 is releasably coupled to the second end 22 of the core 12 and locked into position. A surface of the separable hub 16 is prepared with the coating 46, as described herein above. The second one of the flanges 18 is lifted toward the separable hub 16 and securely coupled to the hub 16 using a pre-determined number of the fastener(s) 42. In certain embodiments, the separable hub 16 is temporarily locked into position using a locking key (not shown), for example. However, once the second one of the flanges 18 is in position, the locking key may be removed and the second one of the flanges 18 restrains the separable hub 16 against the core 12. In certain embodiments, a pre-determined number of the spacers 44 are disposed between the hub 16 and an adjacent one of the flanges 18. Once the flanges 18 are secured, the drum 10 can be positioned for transport, loading of wire, or some other application.

Figure 7:
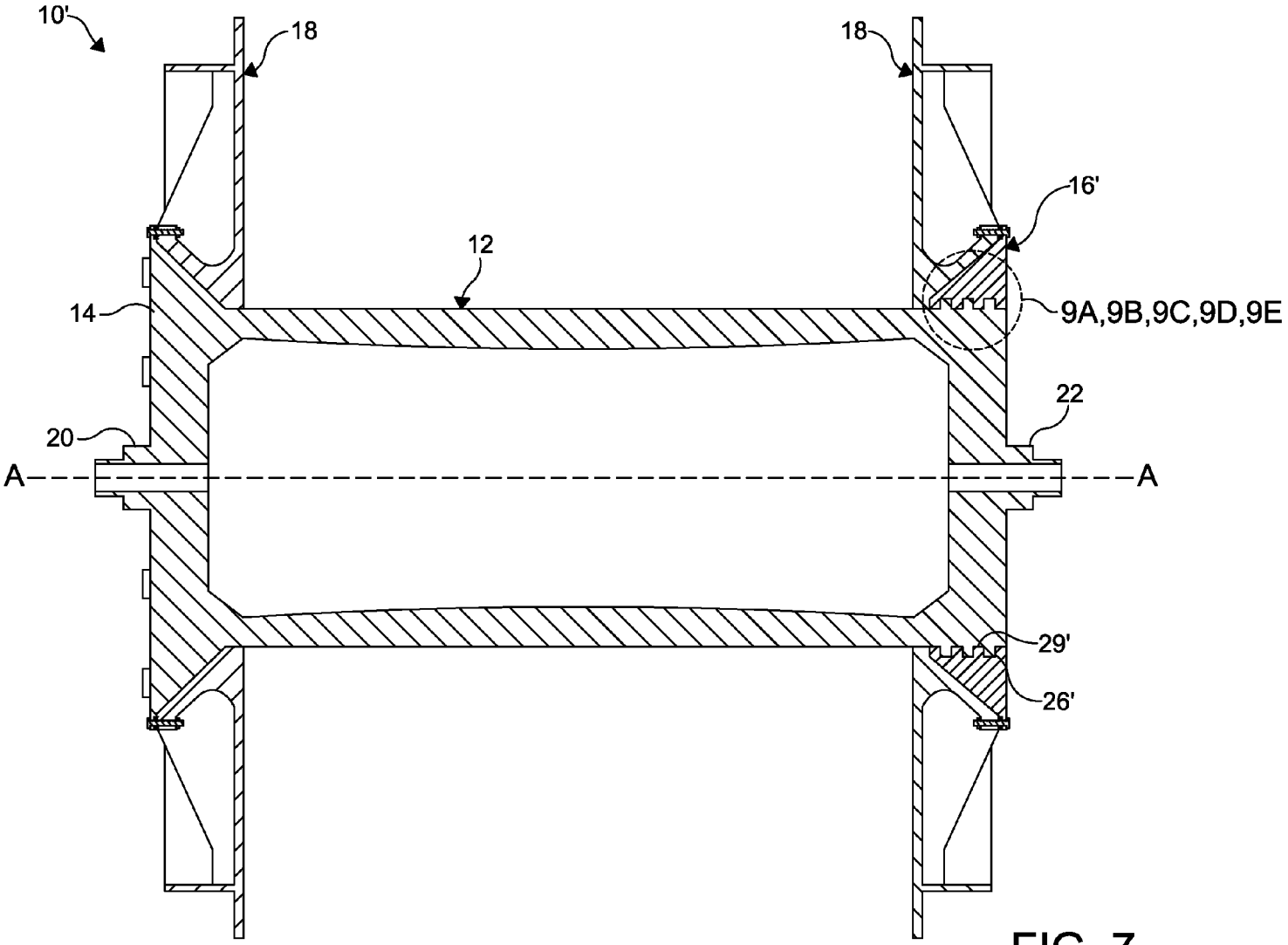
FIG. 7 is a cross-sectional view of a drum assembly according to another embodiment of the present invention.
Figure 8:
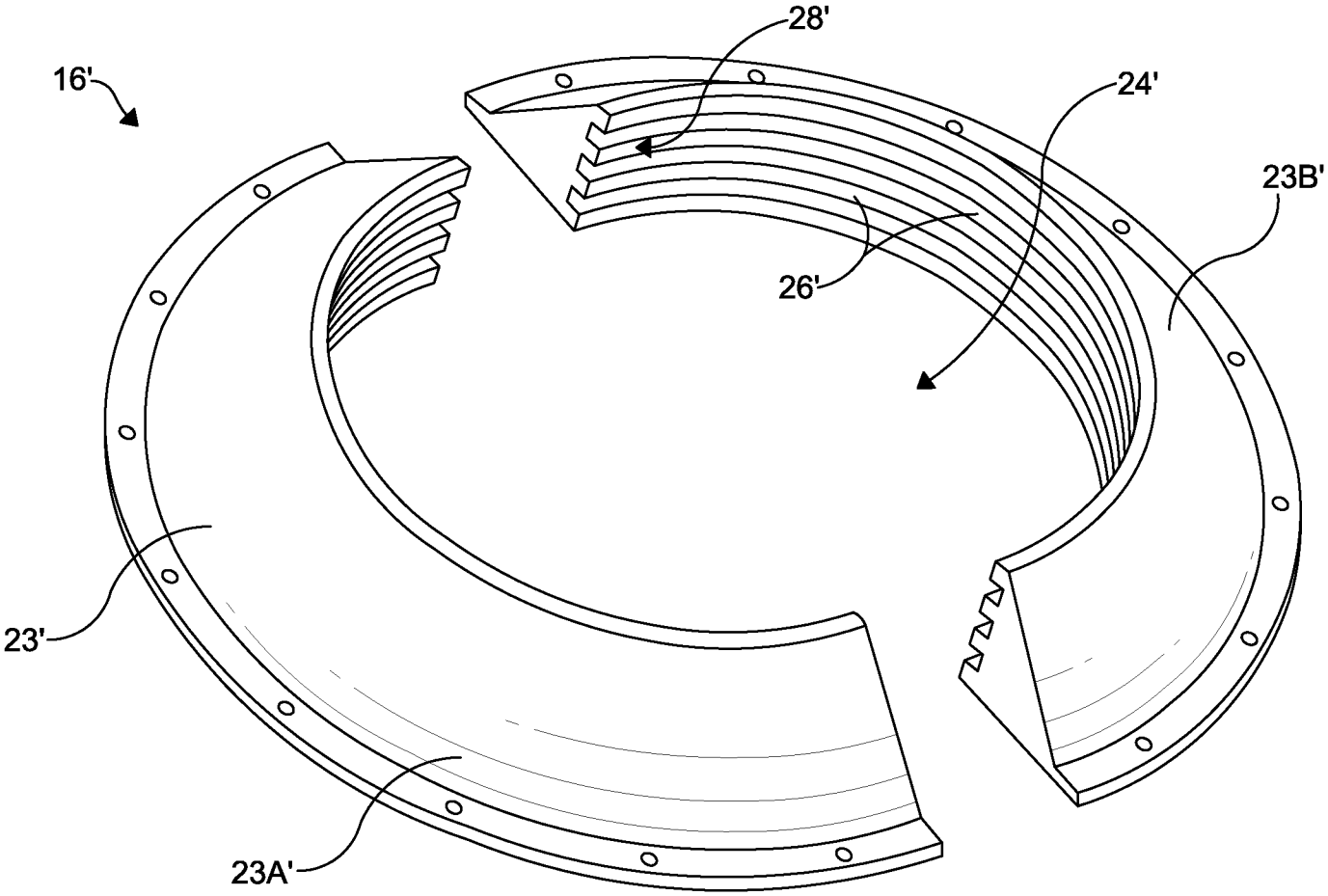
FIG. 8 is an exploded perspective view of a separable hub of the drum assembly of FIG. 7.

FIGS. 7 and 8 illustrate a drum 10' similar to the drum 10, except as described below. As shown, a hub 16' includes a segmented body 23' having a first portion 23A' and a second portion 23B'. It is understood that, in certain embodiments, the first portion 23A' and the second portion 23B' can be coupled together using any conventional coupling means.

Figure 9A:
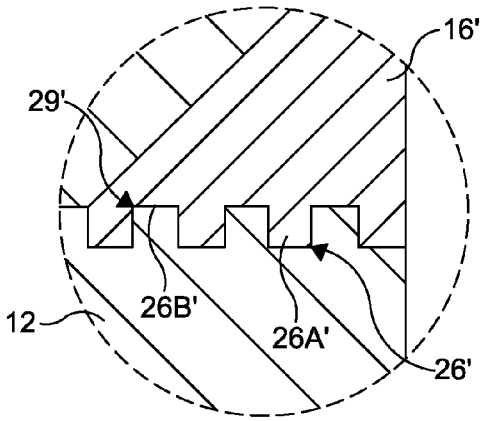
FIGS. 9A-9E are enlarged views of a portion of the drum assembly of FIG. 7, showing an interlocking system.
Figure 9B:
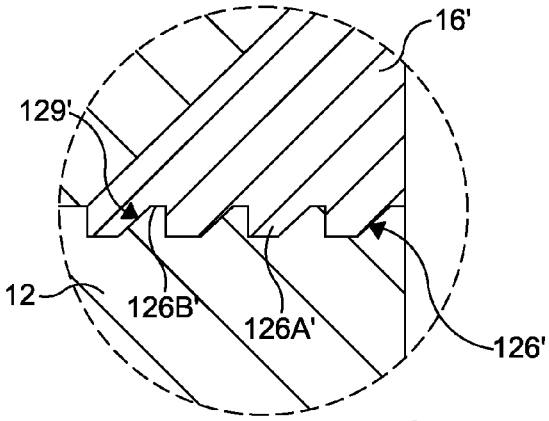
Figure 9C:
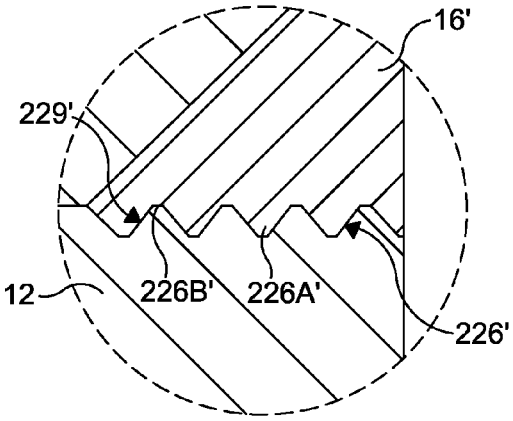
Figure 9D:
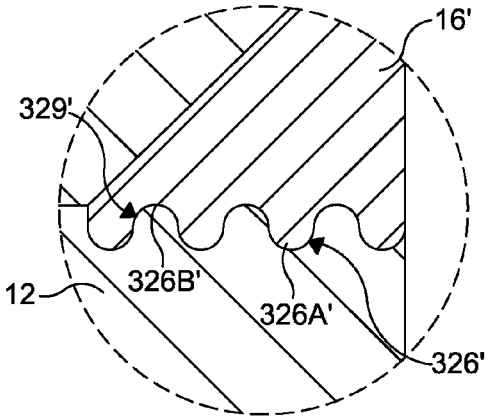
Figure 9E:
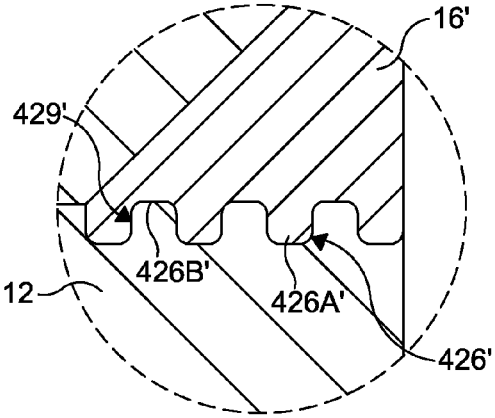
Figure 10A:
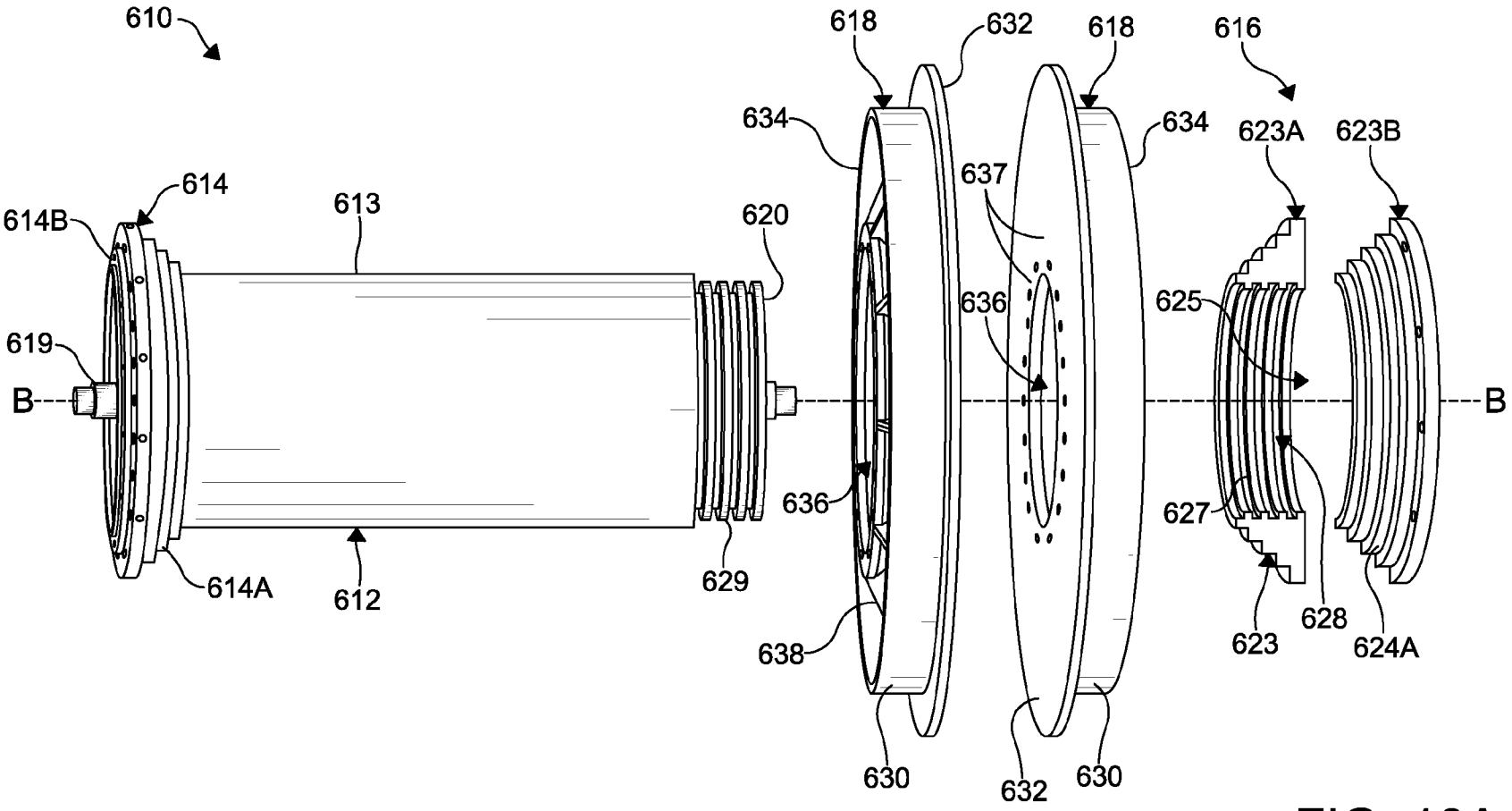
FIG. 10A is an exploded front perspective view of a drum assembly according to another embodiment of the present invention.
Figure 10B:
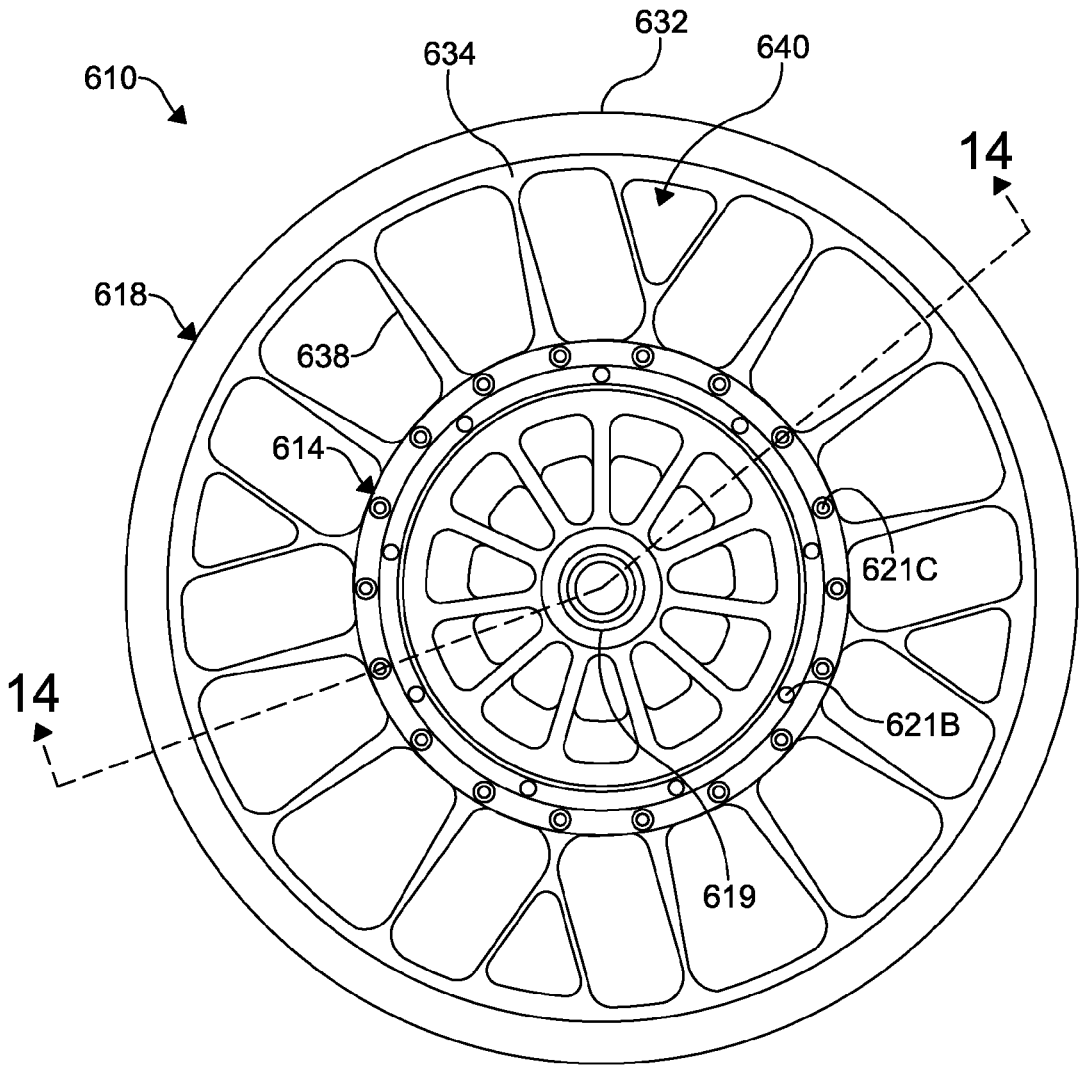
FIG. 10B is a left side elevational view of the drum assembly of FIG. 10A
Figure 11:
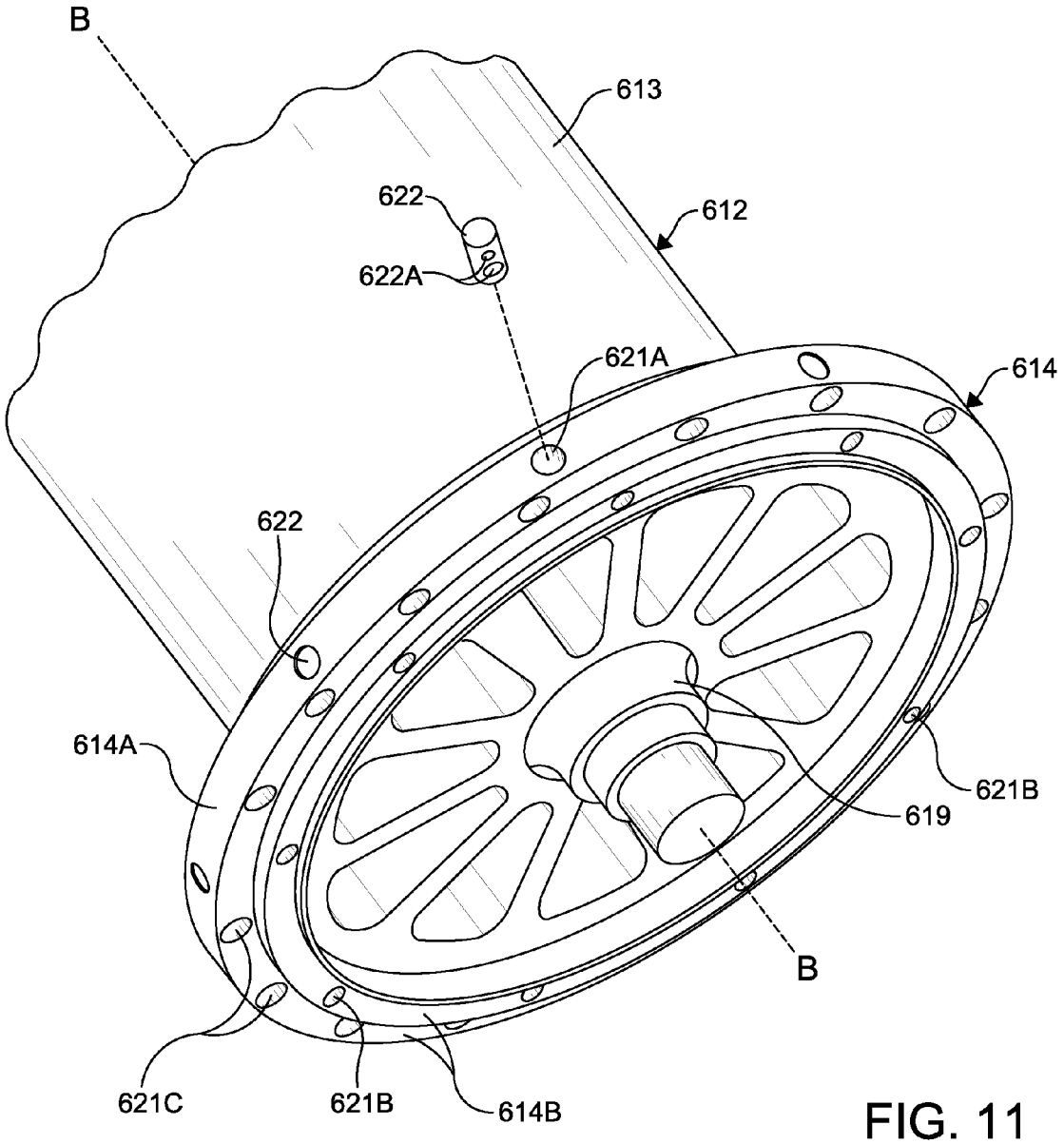
FIG. 11 is an enlarged perspective view of an integral hub of the drum assembly of FIGS. 10A and 10B.
Figure 12:
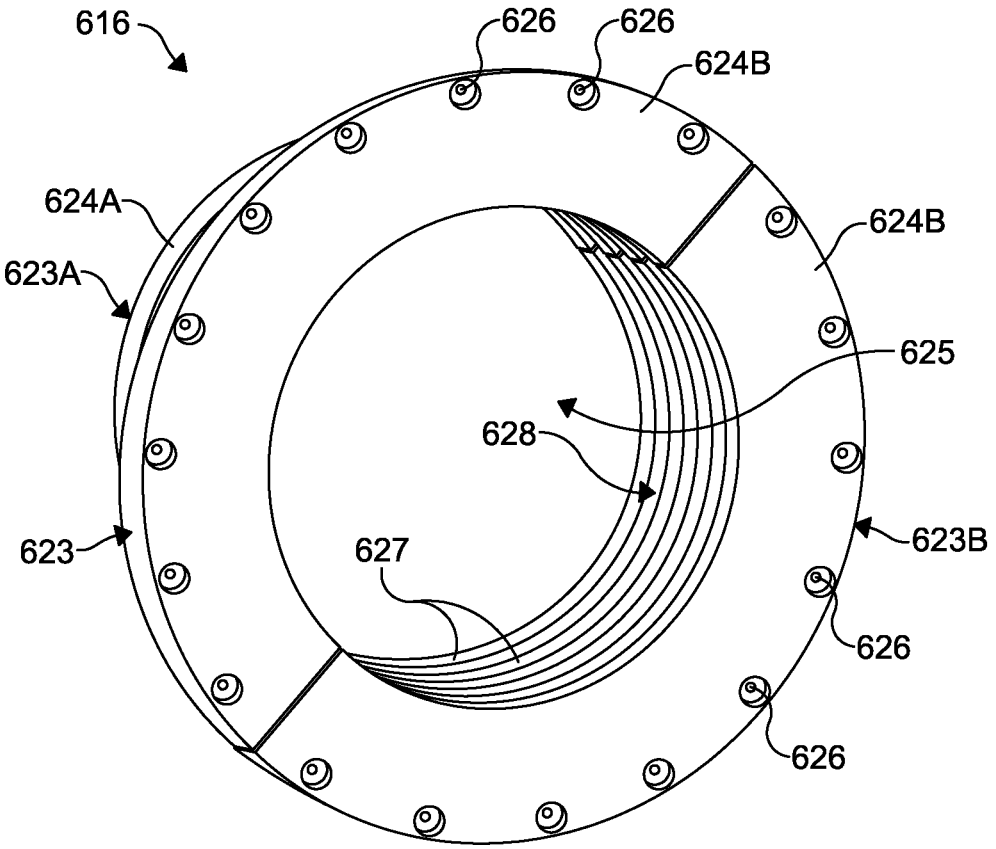
FIG. 12 is an enlarged perspective view of a separable hub of the drum assembly of FIGS. 10A and 10B.
Figure 13A:
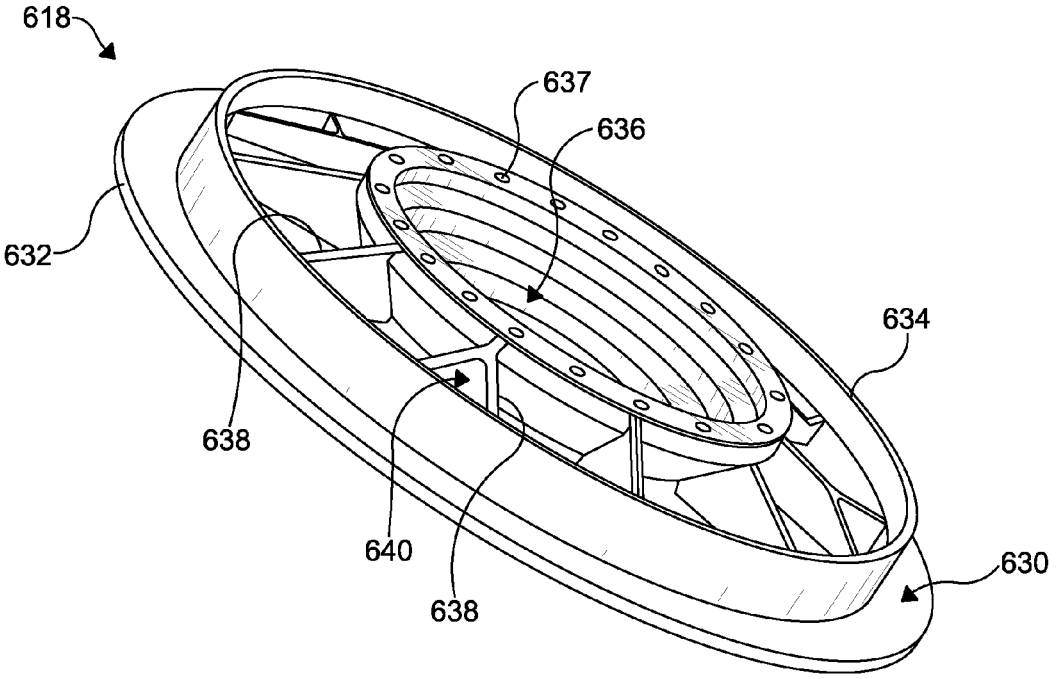
FIG. 13A is a front perspective view of a flange of the drum assembly of FIGS. 10A and 10B.
Figure 13B:
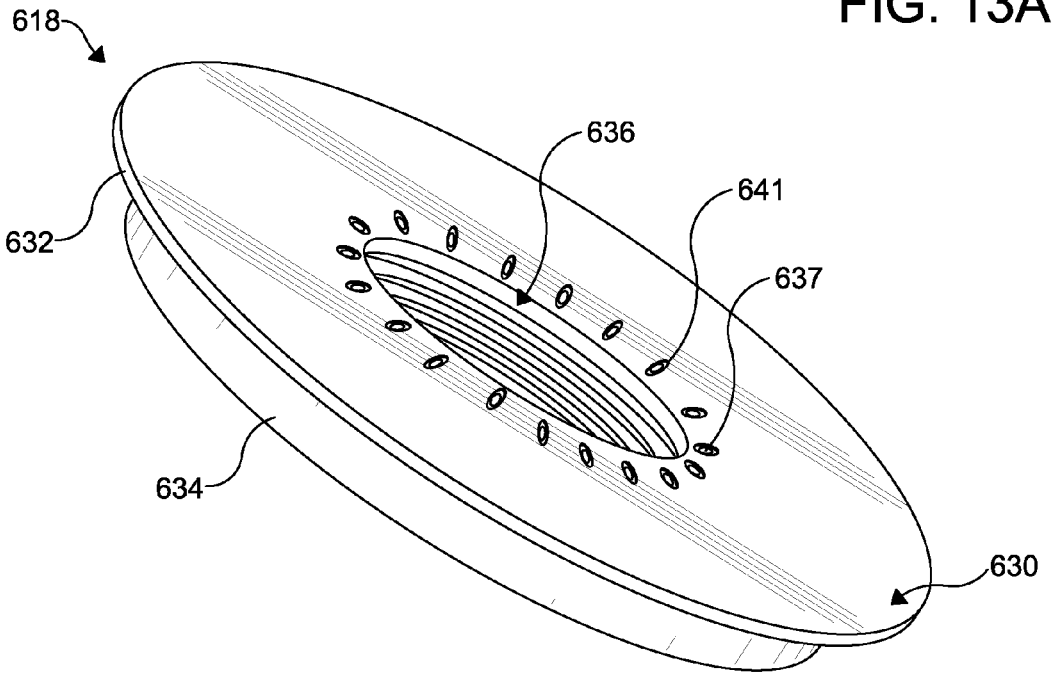
FIG. 13B is a rear perspective view of the flange of FIG. 13A.
Figure 14:
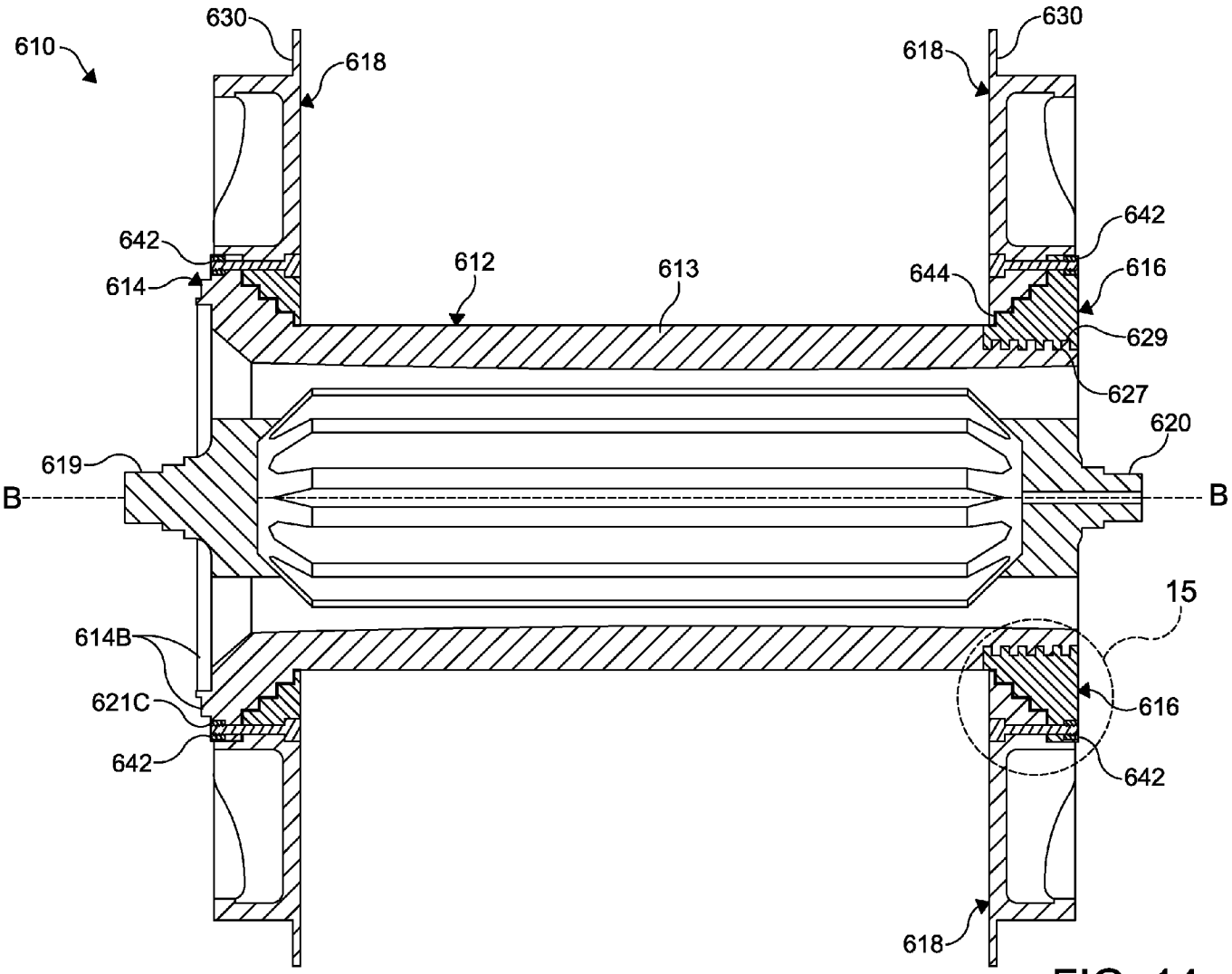
FIG. 14 is a cross-sectional front elevation view of the drum assembly of FIG. 10.

The body 23' of the hub 16' has a generally frusto-conical shape with an aperture 24' formed therein. The hub 16' includes a first coupling mechanism 26' (e.g. interlocking system) formed on an interior surface 28' defining the aperture 24' to couple the hub 16' to a portion of the core 12. As a non-limiting example, the coupling mechanism 26' includes a plurality of alternating ridges 26A' and channels 26B' (as shown in FIG. 9A) arranged to releasably couple the hub 16' and the core 12. As a further non-limiting example, a portion of the core 12 (e.g. adjacent the second end 22 of the core 12) includes a second (i.e. reciprocal or corresponding) coupling mechanism 29' to cooperate with the first coupling mechanism 26' to secure the hub 16' to the core 12. It is understood that the hub 14 can be formed as a separable component from the core 12 and configured substantially similarly to the hub 16'. It is further understood that the segmented body 23' of the hub 16' allows design freedom for the coupling mechanisms 26', 29' beyond that of a helical thread. For example, each of the ridges 26A' and channels 26B' can have any size and shape.

FIGS. 9A-9E illustrate configurations of the coupling mechanisms 26', 29', 126', 129', 226', 229', 326', 329', 426', 429' (e.g. interlocking system) according to various embodiments of the present disclosure. As a non-limiting example, each of the first coupling mechanism 26', 126', 226', 326', 426' includes a plurality of alternating ridges 26A', 126A', 226A', 326A', 426A' and channels 26B', 126B', 226B', 326B', 426B' arranged to releasably couple the hub 16' and the core 12. A portion of the core 12 (e.g. adjacent the second end 22 of the core 12) includes the second coupling mechanism 29', 129', 229', 329', 429' to cooperate with the coupling means 26', 126', 226', 326', 426' to secure the hub 16' to the core 12. It is understood that the coupling means 26', 29', 126', 129', 226', 229', 326', 329', 426', 429' can have any size and shape.

FIGS. 10A, 10B, and 11-15 illustrate a drum 610 (i.e. drum assembly) that may have common features or elements with the drum 10, except as described below. As shown, the drum 610 includes a core 612, a pair of hubs 614, 616 disposed adjacent a portion of the core 612, and a pair of flanges 618 disposed adjacent each of the hubs 614, 616. It is understood that the drum 610 can include additional components such as a sprocket (not shown), for example. It is further understood that the drum 610 can typically store a certain length of cable, depending on a diameter of the core 612 and a length/diameter of the each of the flanges 618.

The core 612 has a generally cylindrical and substantially round cross-sectional shaped body 613 extending along a longitudinal axis B-B and may be configured to rotate about the longitudinal axis B-B. In certain embodiments, the core 612 is hollow. However, it is understood that the core 612 can have any size and shape. In certain embodiments, a first one of the hubs 614 is integrally formed or monolithically formed (e.g. cast or molded) with the core 612 and disposed adjacent a first end 619 of the core 612. In certain embodiments, a second one of the hubs 616 is releasably coupled to the core 612 adjacent a second end 620 of the core 612 opposite the first end 619. It is understood that each of the hubs 614, 616 can be releasably coupled, removably attached, or otherwise secured to the core 612.

The hub 614 has a generally frusto-conical shape with an outer wall 614A having a stepped configuration and a side wall 614B configured to receive a sprocket (not shown). More specifically, an outer diameter of the hub 614 represented by the outer wall 614A increases in a stepped fashion from a pre-determined point along the body 613 of the core 612 toward the side wall 614B, wherein a diameter of the hub 614 is largest adjacent the side wall 614B of the hub 614. However, it is understood that the hub 614 can have any size and shape.

In certain embodiments, the hub 614 includes a plurality of apertures 621A, 621B, 621C formed therein. A first number of the apertures 621A can be formed in a peripheral surface of the largest diameter step of the outer wall 614A. The apertures 621A may be equally spaced around the periphery of the hub 614 and extend in a radial direction such that each of the apertures 621A is configured to receive a sprocket insert 622 therein. As a non-limiting example, the sprocket insert 622 has a generally cylindrical shape with a pair of fixation apertures 622A formed therein. Each of the fixation apertures 622A can be configured to receive a fixation mechanism (not shown) associated with the sprocket. In the embodiment shown, each of the fixation apertures 622A has a different diameter to receive fixation mechanisms having various sizes. It is understood that any mechanism for affixing the sprocket to the hub 614 can be used. A second plurality of the apertures 621B is formed in the side wall 614B of the hub 614 (e.g. in an annular array and extending substantially parallel to the longitudinal axis B-B). Each of the apertures 621B can be aligned with and intersects a respective one of the apertures 621A. As a non-limiting example, each of the apertures 621A can receive one of the sprocket inserts 622 and each of the apertures 621B can receive a fixation mechanism associated with a sprocket. As such, the fixation mechanism extends through each of apertures 621B to couple with a respective one of the sprocket inserts 622 to secure the sprocket to the hub 614. A third number or set of the apertures 621C (i.e. fastener apertures) is formed in the side wall 614B of the hub 614 (e.g. in an annular array and extending substantially parallel to the longitudinal axis B-B). Each of the apertures 621C can be configured to receive one of the fasteners 642 (shown in FIGS. 14 and 15) for coupling one of the flanges 618 to the hub 614.

The separable hub 616 may have a generally frusto-conical shaped body 623 segmented into a first portion 623A and a second portion 623B. Each of the portions 623A, 623B includes an outer wall 624A with a stepped configuration and a side wall 624B with a portion of a core aperture 625. Together the portions 623A, 623B may form the core aperture 625. Numerous fastener apertures 626 can be formed through the side wall 624B. As a non-limiting example, an outer diameter of the hub 616 increases in a stepped fashion from a pre-determined point along the body 623 toward the side wall 624 such that a diameter of the hub 616 is largest adjacent the side wall 624B. However, it is understood that the hub 616 can have any size and shape. The core aperture 625 can be formed in the side walls 624B of each of the portions 623A, 623B and configured to receive at least a portion of the body 613 of the core 612 therethrough. The fastener apertures 626 can be formed in an annular array circumferentially disposed around the core aperture 625. Each of the fastener apertures 626 can be configured to receive one of the fasteners 642 for coupling one of the flanges 618 to the hub 616.

Figure 15:
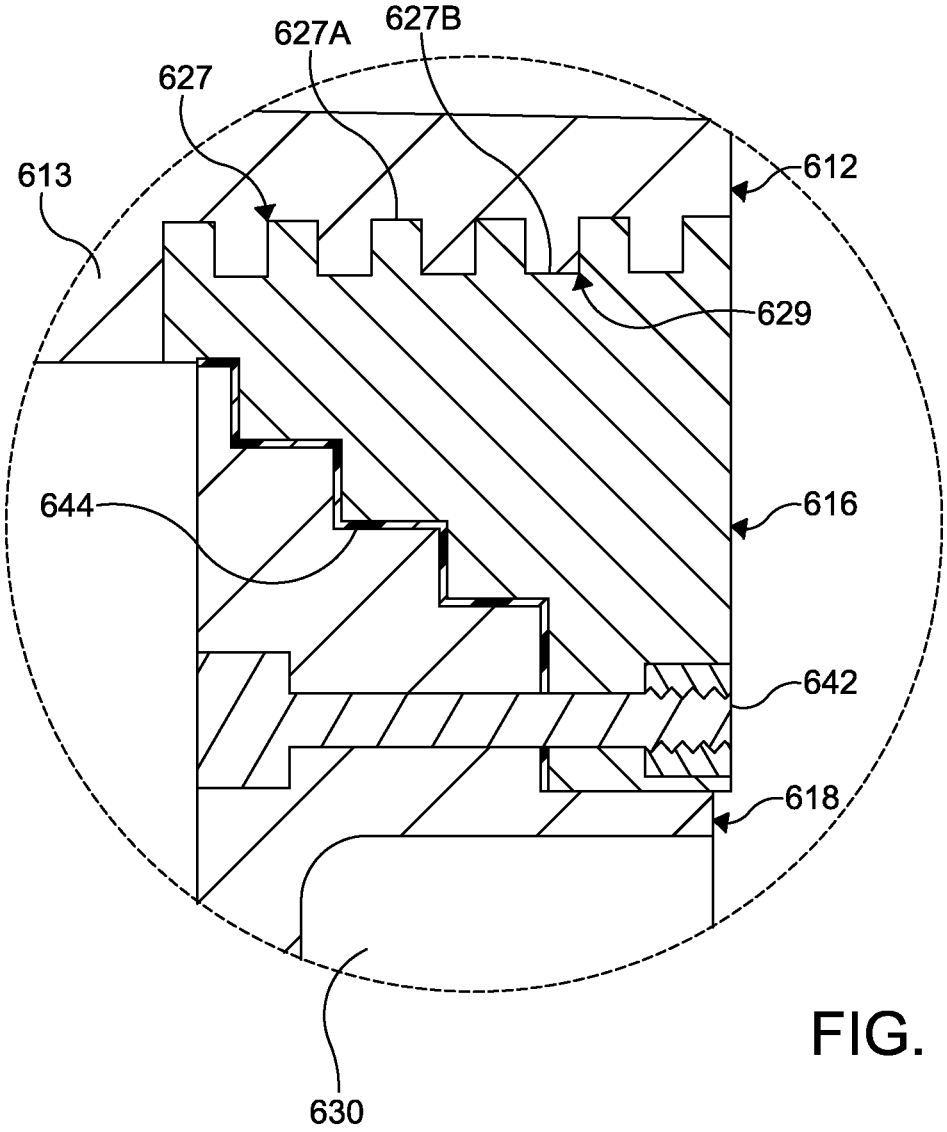
FIG. 15 is an enlarged view of a portion of the drum assembly of FIGS. 10A and 10B taken along line 14-14 of FIG. 10B.

The hub 616 includes a first coupling mechanism 627 (e.g. interlocking system) formed on an interior surface 628 defining the core aperture 625 to couple the hub 616 to a portion of the core 612. As a non-limiting example, the first coupling mechanism 627 includes alternating ridges 627A and channels 627B (as shown in FIG. 15) arranged to releasably couple the hub 616 and the core 612. As a further non-limiting example, a portion of the core 612 (e.g. adjacent the second end 620 of the core 612) includes a second (i.e. reciprocal) coupling means 629 to cooperate with the first coupling means 627 to secure the hub 616 to the core 612. It is understood that the hub 614 can be formed as a separable component from the core 612 and configured substantially similarly to the hub 616. It is further understood that each of the ridges 627A and channels 627B can have any size and shape.

Each of the flanges 618 has a body 630 with an inner surface 632, an outer support structure 634, a hub aperture 636 formed in the body 630, and fastener apertures 637 formed in the body 630. The inner surface 632 of each of the flanges 618 may be substantially planar and can be configured to face the inner surface 632 of another one of the flanges 618 when the drum 610 is assembled. The outer support structure 634 of the body 630 of each of the flanges 618 can includes support spokes 638 extending radially outwardly from the hub aperture 636. At least one of the support spokes 638 can be generally "Y" shaped to provide a designated lifting region 640 (i.e. pocket) for lifting and transporting the assembled drum 610. It is understood that any number of the support spokes 638 can be configured to provide a desired number of the lifting regions 640. The hub aperture 636 can be formed in the body 630 of each of the flanges 618 such that an inner diameter of the aperture 636 is smallest at an end of the flange 618 adjacent the inner surface 632 and largest at an end of the flange 618 adjacent the outer support structure 634. As shown, the aperture 636 has a stepped configuration and is sized to receive one of the hubs 614, 616. As a non-limiting example, the hub aperture 636 of the each of the flanges 618 can be configured to substantially mate with the outer wall 614A, 624A of a respective one of the hubs 614, 616. As a further non-limiting example, each of the flanges 618 is releasably coupled to one of the hubs 614, 616. The fastener apertures 637 are typically formed through at least one of the inner surface 632 and the support structure 634 of the body 630 of each of the flanges 618 and arranged in an annular array circumferential surrounding the hub aperture 636. In certain embodiments, a recessed region 641 is formed in the inner surface 632 of the body 630 of each of the flanges 618 adjacent each of the fastener apertures 637. As a non-limiting example, each of the recessed regions 641 has an oblong shape or other configuration to lock a head of the fastener 642 in order to facilitate a tightening of the fastener 642 from a side opposite the inner surface 632. The outer support structure 634 may be utilized as a surface to engage with a brake or brake band (not shown) when the drum 610 is in use, for example, for conveying a wireline cable for use in a wellbore, such as for use for raising, lowering, powering and communicating with a logging tool.

As more clearly shown in FIG. 15, at least one of the fasteners 642 is disposed through each of the hubs 614, 616 and extends through the body 630 of an adjacent one of the flanges 618. As a non-limiting example, the fastener 642 is a threaded bolt. However, other fasteners can be used. In certain embodiments, a coating 644 (e.g. polymer) is applied to a portion of each of the hubs 614, 616 that abuts a portion of the body 630 of an adjacent one of the flanges 618 when the drum 610 is assembled. It is understood that the coating 644 can be applied to at least one of the hubs 614, 616 and the body 630 of each of the flanges 618 to facilitate a substantially even distribution of load therebetween, as well as to minimize a corrosion thereof. It is understood that the fastener 642 provides a proper placement of each of the flanges 618 in reference to a respective one of the hubs 614, 616 and secures the flanges 618 in the case of an empty drum 610.

In use, the core 612 is positioned such that a pre-defined "sprocket end" (e.g. first end 619) of the core 612 is facing downward. A surface of the integral hub 614 is prepared with the coating 644, as described above. Once the hub 614 is in a proper position, a first one of the flanges 618 is guided over the core 612 such that a portion of the core 612 passes through the hub aperture 636 formed in the body 630 of the first one of the flanges 618. The first one of the flanges 618 is coupled to the integral hub 614 using a pre-determined number of the fastener(s) 642. A second one of the flanges 618 is guided over the core 612 such that a portion of the core 612 passes through the hub aperture 636 formed therethrough. In certain embodiments, the second one of the flanges 618 is lowered over the core 612 to rest on the first one of the flanges 618. Each portion 623A, 623B of the separable hub 616 is disposed adjacent the second end 620 of the core 612 and locked into position. In certain embodiments, a gap is maintained between the portions 623A, 623B of the hub 616 in order to ensure that the portions 623A, 623B do not abut when the assembled drum 610 is loaded with cable (i.e. when there is maximum deformation of the hubs 614, 616 and the flanges 618). A surface of the separable hub 616 is prepared with the coating 644, as described herein above. The second one of the flanges 618 is lifted toward the separable hub 616 and securely coupled to the hub 616 using a pre-determined number of the fastener(s) 642. In certain embodiments, the separable hub 616 is temporarily locked into position using a locking key, for example. However, once the second one of the flanges 618 is in position, the locking key is removed and the second one of the flanges 618 restrains the separable hub 616 against the core 612. Once the flanges 618 are secured, the drum 610 can be positioned for transport, loading of wire, or some other application.

The present invention provides the drum 10, 10', 610 that can eliminate the conventional core/flange junction, while maximizing a cable capacity and a load capacity. The present invention thereby maximizes a useful life of the drum 10, 10', 610 and minimizes cracks formed therein. In addition, an overall drum casting complexity may be minimized and standardization of each element/component can benefit all aspects of manufacturing, including cost and lead-time. Due to replaceable elements/components, a service time and cost associated with servicing the drum 10, 10', 610 is also minimized.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A drum assembly, comprising:

a core having a first end and a second end opposite the first end;

a first hub coupled to the core adjacent the first end of the core, wherein the first hub is coupled to the core by a coupling mechanism that comprises a plurality of helical threads;

a second hub coupled to the core adjacent the second end of the core;

a first flange releasably coupled to the core and the first hub, the first flange including a body having an inner surface, an outer support structure, and an aperture formed therethrough, wherein the outer support structure comprises a plurality of support spokes, and wherein at least one of the support spokes is generally shaped to provide a designated lifting region, wherein a fastener is disposed through the first hub and a body of the first flange, and wherein a spacer is disposed about the fastener and between the body and the first hub; and a second flange releasably coupled to the second hub, wherein the second hub is integral with the core, and wherein the second flange includes a body having an inner surface and an outer support structure.

2. The drum assembly according to claim 1, wherein the first hub includes an aperture formed in a body thereof, the aperture configured to receive at least a portion of the core therethrough.

3. The drum assembly according to claim 1 wherein at least one of the first hub and the second hub is segmented into a plurality of portions.

4. The drum assembly according to claim 1, wherein the support structure of the body of at least one of the flanges includes a plurality of spokes and at least one of the spokes is generally Y-shaped to define a lifting region.

5. The drum assembly according to claim 1, further comprising a coating disposed between at least one of: the first flange and the first hub; and the second flange and the second hub.

* * * * *